US009554661B2

(12) United States Patent
Teuscher

(10) Patent No.: US 9,554,661 B2
(45) Date of Patent: Jan. 31, 2017

(54) MODULAR FRAME SYSTEM

(71) Applicant: Jason B. Teuscher, New York, NY (US)

(72) Inventor: Jason B. Teuscher, New York, NY (US)

( * ) Notice: Subject to any disclaimer, the term of this patent is extended or adjusted under 35 U.S.C. 154(b) by 82 days.

(21) Appl. No.: 14/486,510

(22) Filed: Sep. 15, 2014

(65) Prior Publication Data

US 2015/0082676 A1 Mar. 26, 2015

Related U.S. Application Data

(60) Provisional application No. 61/880,524, filed on Sep. 20, 2013.

(51) Int. Cl.

| | |
|---|---|
| ***A47G 1/06*** | (2006.01) |
| ***G09F 15/00*** | (2006.01) |
| ***A47G 1/08*** | (2006.01) |

(52) U.S. Cl.

CPC ..... *A47G 1/065* (2013.01); *A47G 1/08* (2013.01); *G09F 15/0068* (2013.01)

(58) Field of Classification Search

CPC ..... A47G 1/065; A47G 1/08

See application file for complete search history.

(56) References Cited

U.S. PATENT DOCUMENTS

| | | | | |
|---|---|---|---|---|
| 1,557,058 | A | 10/1925 | Johansen | |
| 2,100,976 | A | 11/1937 | Norton | |
| 2,207,720 | A | 7/1940 | Cole et al. | |
| 2,209,972 | A * | 8/1940 | Horwitt | 40/739 |
| 2,370,794 | A | 3/1945 | Walter | |
| 2,636,556 | A | 4/1953 | Light et al. | |
| 2,855,241 | A | 10/1958 | Walter | |
| 3,075,805 | A | 1/1963 | Golde et al. | |
| 4,641,700 | A | 2/1987 | Zveibil | |
| 5,090,145 | A * | 2/1992 | Chiang et al. | 40/605 |
| 5,231,708 | A | 8/1993 | Hansen | |
| 5,448,841 | A * | 9/1995 | Hampton | 40/730 |
| 5,826,397 | A * | 10/1998 | Armold | G09F 15/0068 52/641 |
| 6,370,803 | B1 * | 4/2002 | Burquest | 40/607.04 |
| 6,758,354 | B2 * | 7/2004 | Carletti | G09F 15/0068 211/182 |
| 7,020,993 | B2 * | 4/2006 | Pritchard | G09F 15/0068 248/329 |
| 7,231,954 | B2 * | 6/2007 | Green | E01F 13/022 135/114 |
| 7,509,763 | B1 * | 3/2009 | Alverson | 40/605 |
| 7,971,622 | B2 * | 7/2011 | Trionfetti | E04B 2/7416 160/122 |
| 8,707,595 | B2 * | 4/2014 | Beemsterboer et al. | 40/515 |

(Continued)

FOREIGN PATENT DOCUMENTS

| | | |
|---|---|---|
| KR | 100 817 245 B1 | 3/2008 |
| WO | WO 2011/129864 | 10/2011 |

*Primary Examiner* — Charles A Fox
*Assistant Examiner* — Christopher E Veraa
(74) *Attorney, Agent, or Firm* — Cesari and McKenna, LLP

(57) ABSTRACT

A modular framing assembly is provided. Each individual module comprises one or more retractable slats that may be extendable to connect with another individual module. The individual modules may be arranged in a plurality of angles and configurations to create frames of varying sizes, shapes and that are capable of bending around corners, where two wall meet.

15 Claims, 5 Drawing Sheets

(56) References Cited

U.S. PATENT DOCUMENTS

| | | | | |
|---|---|---|---|---|
| 2003/0038829 | A1* | 2/2003 | McMillan | G09F 15/0068 715/700 |
| 2004/0060499 | A1* | 4/2004 | Penque, Jr. | 116/63 P |
| 2012/0119907 | A1* | 5/2012 | Teuchert | 340/541 |
| 2013/0068401 | A1 | 3/2013 | Birkestrand | |
| 2014/0027070 | A1 | 1/2014 | Birkestrand | |

* cited by examiner

MODULAR FRAME SYSTEM

CROSS-REFERENCE TO RELATED APPLICATIONS

The present application claims the benefit of U.S. Provisional Patent Application Ser. No. 61/880,524, which was filed on Sep. 20, 2013, by Jason T. Birkestrand for a MODULAR FRAME SYSTEM and is hereby incorporated by reference.

FIELD OF THE INVENTION

The present invention relates to frame systems and more particularly, to modular frame assemblies.

BACKGROUND INFORMATION

Frame assemblies typically have a predefined size and shape. As such, a user that wishes to frame a plurality of pictures or paintings that have different dimensions may be required to purchase different frame assemblies, each of which accommodates a different sized picture or painting. Further, individual frame assemblies typically lie on a surface such a flat wall, and cannot accommodate corners or an edge where two walls meet.

SUMMARY OF THE INVENTION

A modular framing system is provided that comprises of a plurality of individual modules. Each individual module comprises an exterior housing having one or more exit points for retractable slats. Interior to the housing are one or more coiled slats that may be extended, similar to a tape measure. A slat, that exits the housing exterior of the module may connect to or be coupled to the exterior housing of a different module and/or to a slat of a neighboring module. For example, a plurality of modules may be coupled together to form a frame (e.g., closed circuit such as a square) that may hold or surround a picture, or to form any of a variety of shapes desired by a user. Each individual module may further include a mechanism that allows the module to be attached to a wall. For example, such mechanism may be an adhesive layer on one side of the module, or a recess or hole in the individual module that allows the module to rest or sit on a nail protruding from a wall surface.

BRIEF DESCRIPTION OF THE DRAWINGS

The above and further advantages of the invention may be better understood by referring to the following description in conjunction with the accompanying drawings.

DETAILED DESCRIPTION OF AN ILLUSTRATIVE EMBODIMENT

Figure 1:
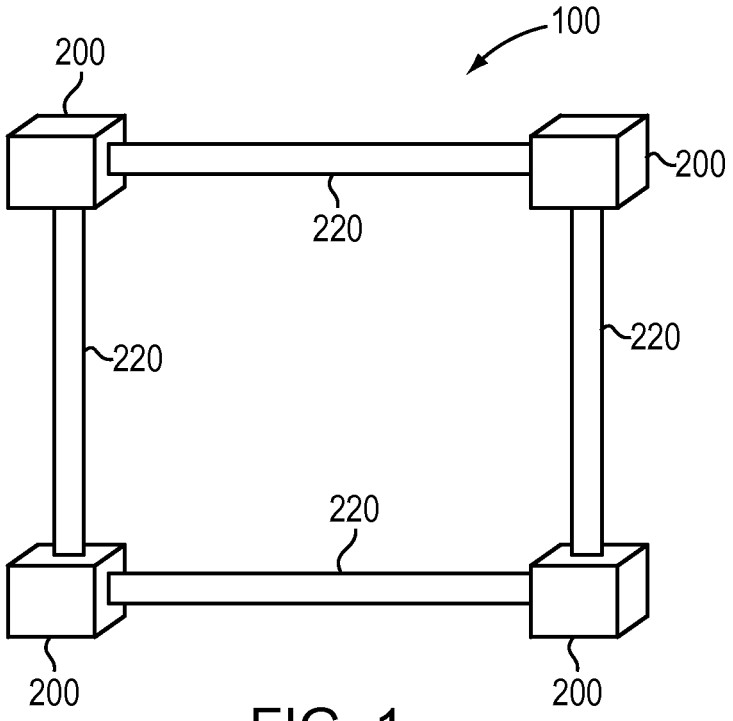
FIG. 1 is an exemplary modular frame assembly in accordance with an illustrative embodiment of the present invention.

FIG. 1 is a schematic diagram of an exemplary modular frame assembly 100 in accordance with an illustrative embodiment of the present invention. The modular frame assembly 100 comprises of a plurality of individual modules 200 that are physically interconnected via a retractable slats 220. Specifically, each retractable slat 200 may be connected to the exterior housing of a different module 200 or to the slat 220 of a neighboring module 200. For example, slat 220 may have a mechanism on its end that allows slat 220 to be secured to the exterior housing of the different module 200. In alternative embodiments, two slats 220 of neighboring modules 200 may be connected to each other, utilizing a hooking mechanism or a different securing mechanism. In the exemplary embodiment, modular frame assembly 100 of FIG. 1 includes four individual modules 200 that are utilized and connected to generate a square/rectangular frame that, for example, may hold a picture or painting. For example, a magnet may be utilized on the slat 220 to secure the picture or the painting to the slat 220, as the slat 220 may have a magnetic composition. It should be noted that in alternative embodiments, a varying number of individual modules 200 may be utilized to create any shape that a user may desire. As such, the description of four modules 200 as shown in FIG. 1 should be taken as exemplary only.

Figure 2:
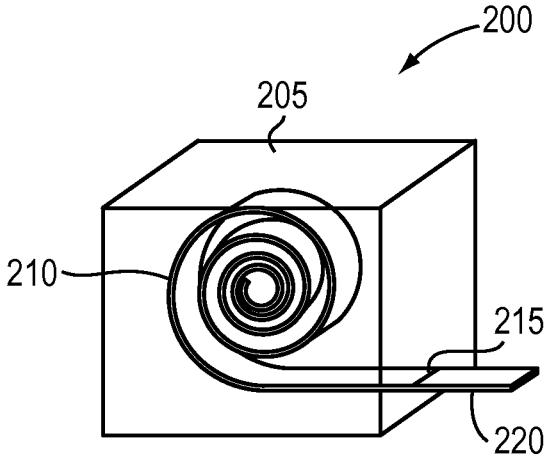
FIG. 2 is an exemplary cross section of an individual module of a modular frame assembly in accordance with an illustrative embodiment of the present invention.

FIG. 2 is an exemplary cross section of an exemplary individual module 200 in accordance with an illustrative embodiment of the present invention. The individual module 200 comprises a housing 205 that further comprises an exit that enables a retractable slat 220 that is extended from a coiled portion 210 within the housing 205. In accordance with illustrative embodiments of the present invention, the housing 205 may house any number of slats and may be comprised of any type of material including, for example, wood, metal, plastic, etc. Similarly, slat 220 may be comprised of any type of material including, for example, metal, plastic, designed, etc. Moreover, different types of materials may be placed over slat 220, for example, a cloth, that decorates the slat 220. Further, it is noted that the displayed housings are cube in shape, however in alternative embodiments of the present invention, the housings may be of various shapes including, for example cubes, spheres, octagonal, etc. As such, the description of the housing being a cube should be taken as exemplary only. Further, it is noted that module 200 includes a single retractable slat 200 that extends from a single coiled portion 210, however housing 205 may house a plurality of retractable slats 220 that extends from respective coiled portions 201 that reside in housing 205. Moreover, retractable slat 220 may be coupled to the exterior housing 205 of a different module 200 or to a slat 220 of a neighboring module 200 using any of a variety of techniques, as know by those skilled in the art. For example, the retractable slat 220 may be inserted into a slot of a different or neighboring module 200, or the retractable slat 220 may have a connecting means that allows it to be secured to a different slat 220 of a different or neighboring module 200.

Figure 3A:
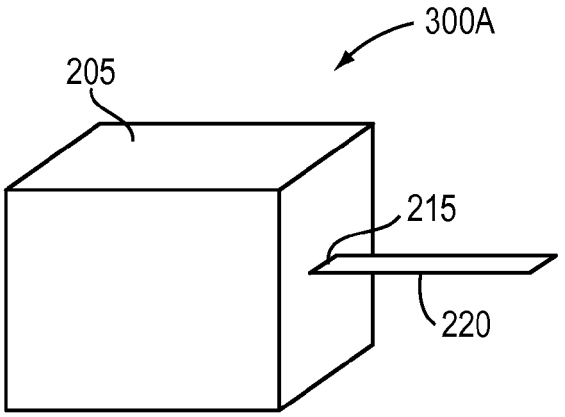
FIG. 3A is a side view of an exemplary individual module of a modular frame assembly illustrating an exemplary slat exit point in accordance with an illustrative embodiment of the present invention.
Figure 3B:
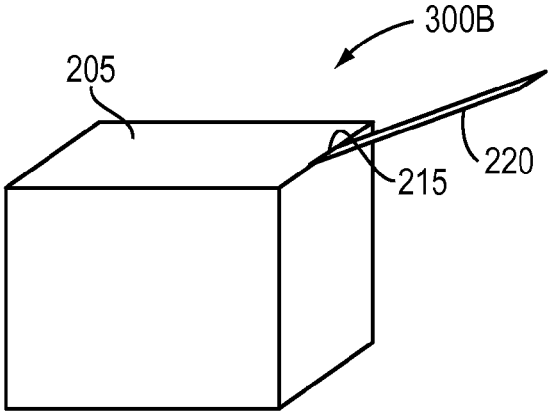
FIG. 3B is a side view of an exemplary individual module of a modular frame assembly illustrating an exemplary slat exit point in accordance with an illustrative embodiment of the present invention.
Figure 3C:
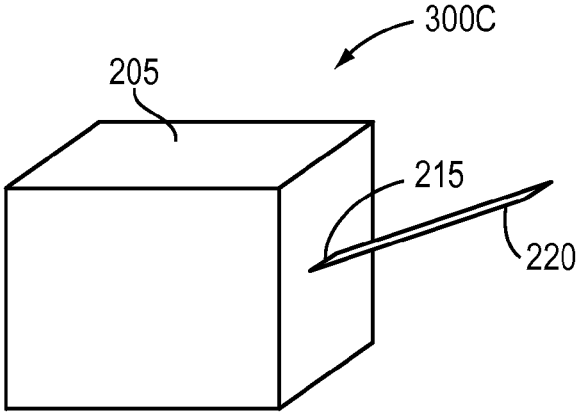
FIG. 3C is a side view of an exemplary individual module of a modular frame assembly illustrating an exemplary slat exit point in accordance with an illustrative embodiment of the present invention.

FIG. 3A is a side view of an exemplary individual module 300A illustrating an exemplary exit point in accordance with an illustrative embodiment the present invention. In the exemplary FIG. 3A, exit 215 is located at a center on one of the faces of the housing 205. FIG. 3B is a side view of an exemplary individual module 300B illustrating an exemplary exit point in accordance with an illustrative embodiment the present invention. In the exemplary FIG. 3B, exit 215 is located at a corner or edge position of the housing 205. FIG. 3C is a side view of an exemplary individual module 300C illustrating an exemplary exit point that is angled in accordance with an illustrative embodiment the present invention. In the exemplary FIG. 3C, exit 215 it angled with respect to one of the faces of the housing 205. Specifically, instead of the slat exiting the module in a perpendicular fashion, slat may exit module 300C at an angle with respect to the side of the module 300C. It is noted that the angle and position of the exit 215 may vary and the examples as illustrated in FIGS. 3A, 3B, and 3C are simply exemplary in nature.

Figure 4:
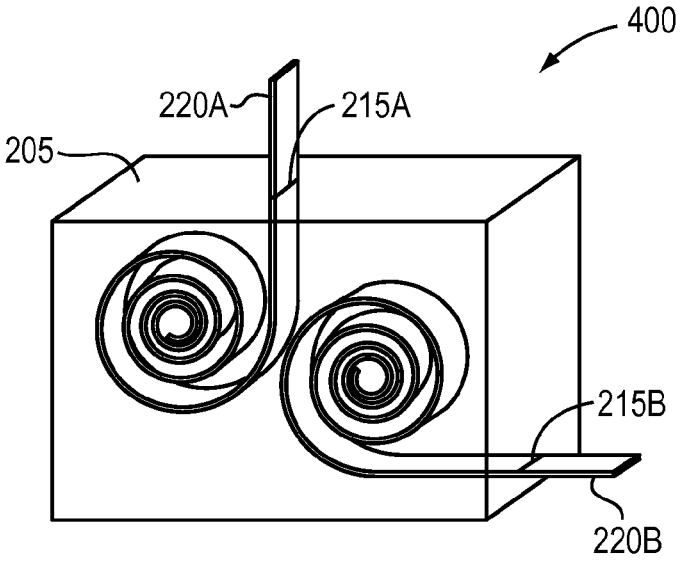
FIG. 4 is a cross section of an exemplary individual module of a modular frame assembly having a plurality of framing slats in accordance with an illustrative embodiment of the present invention.

FIG. 4 is a cross section of an exemplary individual module 400 of a modular frame assembly having a plurality of slats 220 in accordance with an illustrative embodiment of the present. Exemplary individual module 400 comprises a housing 205 having slat exit 215A and slat exit 215B respectively associated with slats 220A and 220B. The individual module 400 may be utilized to generate a modular frame assembly in three dimensions, such as described below with reference to FIG. 5. Exemplary module 400 is shown and described having two slats, however, in alternative embodiments, a module may comprise one or more slats 220 exiting on one or more sides of the housing at different locations on any face of module 400. For example, a module may have two or more slats exiting from the same side of the module at varying angles. As such, the description contained herein of module 400 comprising two slats exiting on adjacent faces of the module should be taken as exemplary only.

Figure 5:
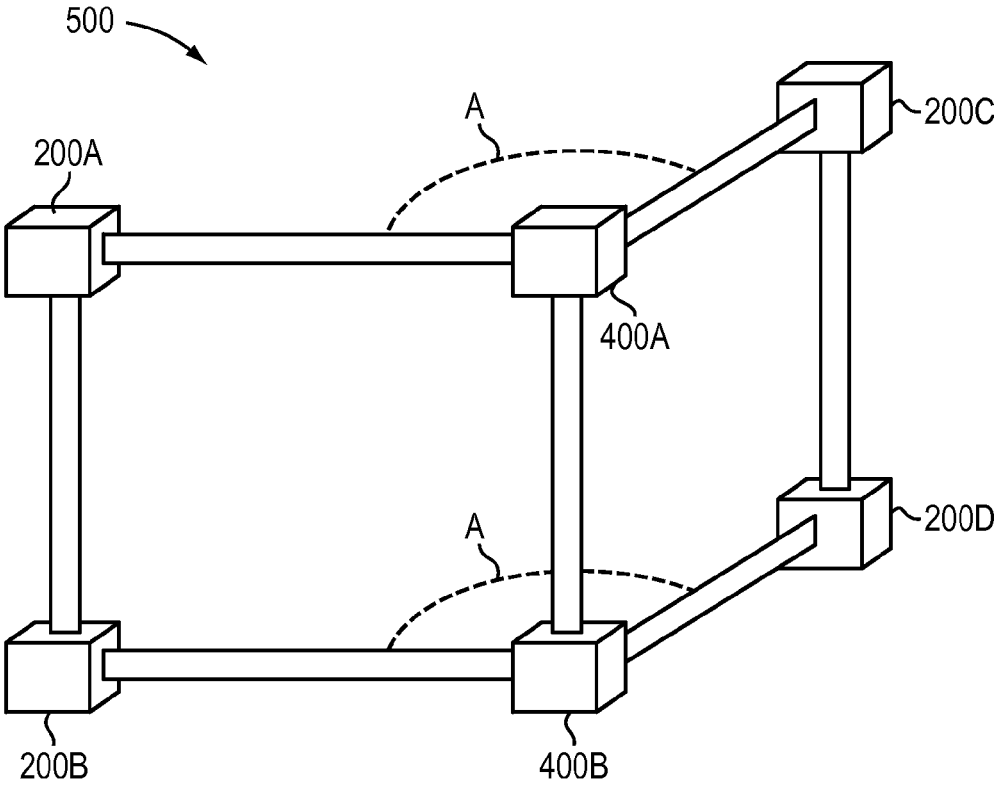
FIG. 5 is an exemplary modular frame assembly illustrating a corner arrangement in accordance with an illustrative embodiment of the present invention.

FIG. 5 is an exemplary modular frame assembly 500 illustrating a corner arrangement in accordance with an illustrative embodiment of the present invention. Frame assembly 500 is illustratively comprised of six individual modules 200A, 200B, 200C, 200D, 400A, and 400B. The arrangement illustratively comprises two multi-slat modules 400A and 400B that are illustratively configured with a plurality of slats exiting from different faces of the individual module. Four individual modules 200A, 200B, 200C, and 200D are arranged as endpoints of frame assembly 500. Illustratively, the corner modules, 400A and 400B, are angled with angle A. In an illustrative embodiment, Angle A comprises 90°; however in alternative embodiments the angle may be different from 90° to accommodate corners at different angles. As such, it should be noted that the exemplary description of the coordinate comprising a 90° angle to be taken as exemplary only. Frame assembly 500 may be utilized to accommodate two different pictures or advertisement, or a single picture or advertisement that may span a corner where two walls meet.

Figure 6:
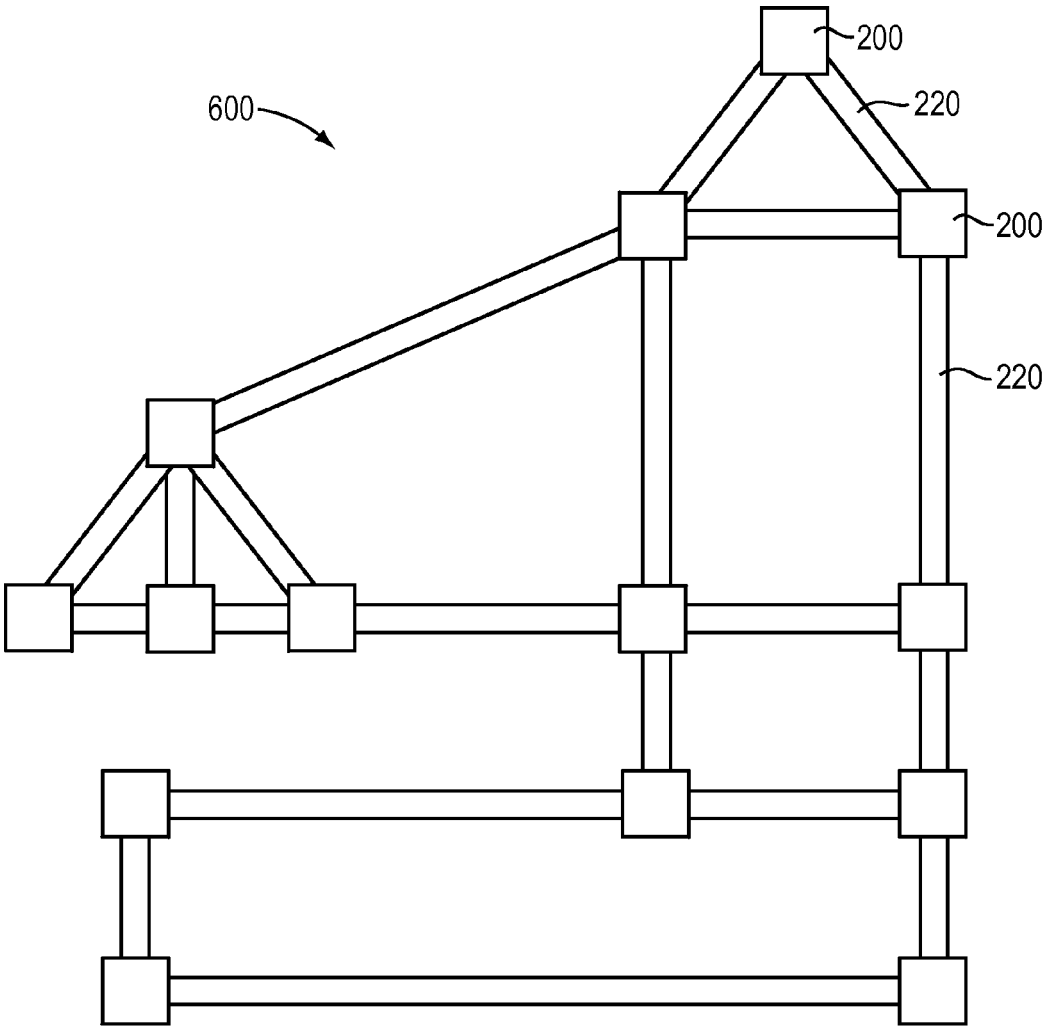
FIG. 6 is an exemplary modular frame assembly illustrating a sail boat in accordance with an illustrative embodiment of the present invention.

FIG. 6 is an exemplary modular frame assembly 600 illustrating a sail boat. Specifically, a plurality of individual modules 200 and their respective slats 220 are coupled or connected to each other, to form the shape of a sailboat. A plurality of pictures, or advertisements, may be placed within the area between modules 200 that make up frame assembly 600 that is the shape of a sailboat. Alternatively, the areas between modules 200 may be left empty, and frame assembly 600 that is the shape of a sailboat may simply represent an artistic shape created by a user. It is noted that the frame assembly 600 in the shape of a sail boat is simply exemplary in nature, and modules 200 may be connected to form any desired shape. For example, the modular assembly may be utilized to create framing or building blocks by moving the slats 220 to a desired length extending from the exit of the module 200, and then connecting the slat 220 to different slats/modules, as described above. The frame assembly may be also be utilized to house or hold a banner, for example, that may be large in size. In such instances, the base of the frame assembly, that includes one or more modules, may include a plurality of slats 220. The plurality of slats may provide a sturdier or stronger framing assembly.

Figure 7:
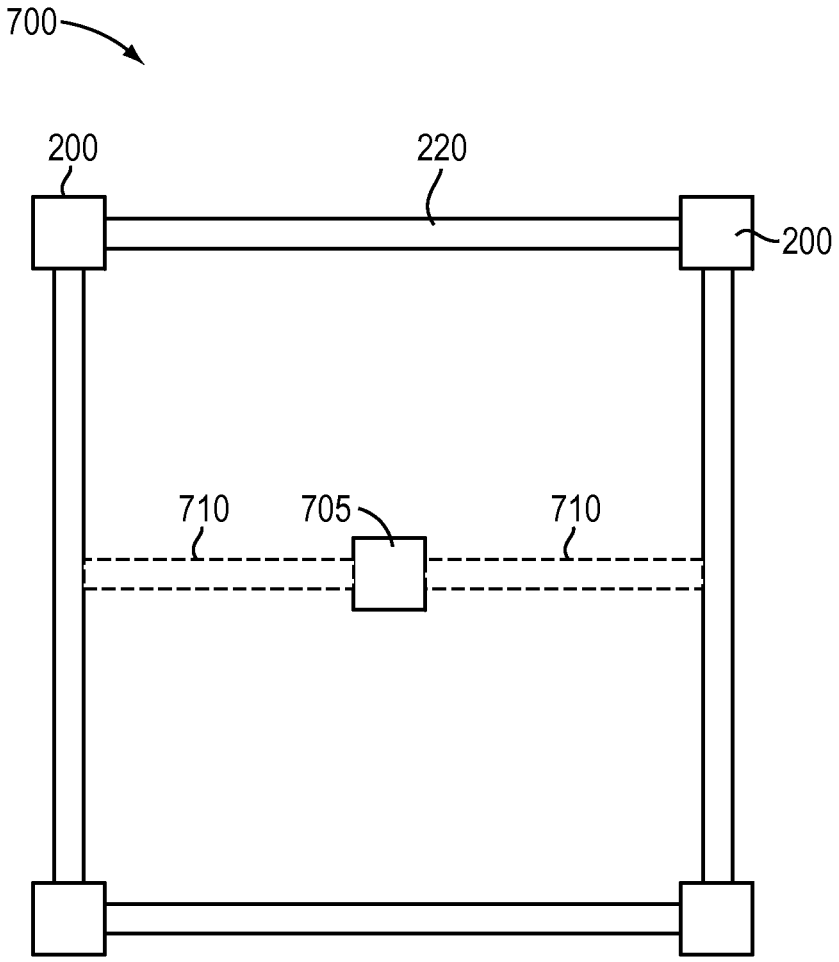
FIG. 7 is an exemplary modular frame assembly with a support in accordance with an illustrative embodiment of the present invention.

FIG. 7 is an exemplary modular frame assembly 700 with a support 705 in accordance with an illustrative embodiment of the present invention. Specifically and as illustrated in FIG. 7, modules 200 and their respective slats 220 may be connected to make a rectangular frame. In certain instances, frame assembly 700 may be large, thus requiring a further support to maintain a picture or banner. Specifically, support 705 may be, for example, a module placed at the center of assembly 700, which may have two slats 710 (indicated by the dashed lines) extending from a housing of support 705. The slats 710 extending from support 705 may then be attached to the slats 220 extending from modules 200. It is noted that the modular frame assembly 700, which includes support 705, illustrates two slats 710 extending from the housing of support 705. However, any number of slats 710 may be used. For example, four slats 710 may be utilized, with each slat connecting to a different side of modular frame assembly 700. Support 705 adds strength or sturdiness to frame assembly 700. Further, in a preferred embodiment, a picture, painting, or advertisement may be attached to the housing of support 705. For example, a string, traversing the backside of a picture may be secured on a hook, that may for example, be on the housing of support 705, as known by those skilled in the art.

It should be apparent from the foregoing that the frame assemblies have great versatility and can be configured in any shape desired, to surround a variety of objects, such as, but not limited to, pictures, banners, paintings, televisions, advertisements. Further, in alternative embodiments, the modules and their respective slats may be connected to make particular shapes, such as sail boats, cars, or any other design that a user desires. The areas between the modules, may be occupied with pictures or other items, or may remain empty.

It will thus be seen that the objects set forth above among those made apparent from the preceding description are efficiently attained. Also, since certain changes may be made to the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. A frame assembly, 1 comprising:

a plurality of modules, each module including a housing and at least one slat;

each housing attached to a wall, and including at least one exit;

the at least one slat extending and retracting from the exit of the housing, the at least one slat coupled to a different housing or a different slat of the different housing, where the plurality of housing and the plurality of slats, associated with the plurality of modules, surround an object to form the frame assembly; and a support module including a support housing and a first support slat and a second support slat, wherein the first support slat and the second support slat exit the support housing through support exits located on directly opposites sides of the support housing, the first support slat and the second support slat extend and retract from within the support housing, and when the first support slat and the second support slate extend from the support housing the first and the second support slats are substantially parallel to each other, the first support slat attached to a first selected slat of the plurality of slats that surround the object to substantially form a first right angle with the first selected slat, and the second support slat attached to a second selected slat of the plurality of slats that surround the object to substantially form a second right angle with the second selected slat, where the first selected slat and the second selected slat are different slats.

2. The frame assembly of claim 1, wherein the plurality of modules are coupled as a closed circuit to form the frame assembly.

3. The frame assembly of claim 1, wherein the object is a picture.

4. The frame assembly of claim 1, wherein the housing is attached to the wall utilizing an adhesive layer on one side of the housing or utilizing a recess in the housing that allows the housing to sit on a nail protruding from the wall.

5. The frame assembly of claim 1, wherein the at least one slat is coupled to the different housing or the different slat utilizing a hooking mechanism.

6. The frame assembly of claim 1, wherein the at least one slat has a magnet composition to attach the at least one slat to the object.

7. The frame assembly of claim 1, where the at least one slat is coiled into the housing and uncoils as the at least one slat exits the exit of the housing.

8. The frame assembly of claim 1, wherein the at least one slat is coupled to the different housing by inserting the at least one slat into the exit of the different housing.

9. The frame assembly of claim 1, wherein the exit is in a middle of a side of the housing.

10. The frame assembly of claim 1, wherein the exit is at a corner of the housing where two sides of the housing meet.

11. The frame assembly of claim 1, wherein the exit is angled with respect to a horizontal axis such that the at least one slat exits the housing at an angle with respect to the horizontal axis.

12. The frame assembly of claim 1, where the housing includes two slats wherein each of the two slats respectively exit a different exit of two exits of the housing.

13. The frame assembly of claim 12, wherein the two different exits are on different sides of the housing.

14. The frame assembly of claim 12, wherein the two different exits are on the same side of the housing, and wherein the two exits are at different angles with respect to a horizontal axis.

15. The frame assembly of claim 1, wherein the plurality of modules include at least two corner modules having at least two exits such that the at least two corner modules are coupled to other modules to surround the object that extends over a corner where two walls meet.

* * * * *